US010125460B2

(12) United States Patent
Szekely

(10) Patent No.: US 10,125,460 B2
(45) Date of Patent: Nov. 13, 2018

(54) PEDESTRIAN TILE, REPLACEABLE TILE SECTION AND/OR RESILIENT DOME STRUCTURE

(71) Applicant: Kenneth Eugene Szekely, Oakville, CA (US)

(72) Inventor: Kenneth Eugene Szekely, Oakville, CA (US)

(73) Assignee: Astra Capital Incorporated, Mississauga (CA)

( * ) Notice: Subject to any disclaimer, the term of this patent is extended or adjusted under 35 U.S.C. 154(b) by 0 days.

(21) Appl. No.: 15/445,526

(22) Filed: Feb. 28, 2017

(65) Prior Publication Data

US 2017/0241089 A1 Aug. 24, 2017

Related U.S. Application Data

(62) Division of application No. 12/721,279, filed on Mar. 10, 2010, now Pat. No. 9,605,388.

(60) Provisional application No. 61/159,318, filed on Mar. 11, 2009.

(51) Int. Cl.

| | |
|---|---|
| ***E01F 9/512*** | (2016.01) |
| ***E01C 5/00*** | (2006.01) |
| ***E01C 5/22*** | (2006.01) |
| ***E04F 15/02*** | (2006.01) |
| ***E01F 9/553*** | (2016.01) |
| *E01C 5/16* | (2006.01) |
| *E01C 5/18* | (2006.01) |
| *E01C 11/24* | (2006.01) |

(52) U.S. Cl.

CPC ..... *E01F 9/512* (2016.02); *E01C 5/00* (2013.01); *E01C 5/22* (2013.01); *E01F 9/553* (2016.02); *E04F 15/02* (2013.01); *E04F 15/02172* (2013.01); *E04F 15/02177* (2013.01); *H05K 999/99* (2013.01); *E01C 5/16* (2013.01); *E01C 5/18* (2013.01); *E01C 11/24* (2013.01); *E01C 2201/20* (2013.01); *E04F 2015/02116* (2013.01)

(58) Field of Classification Search

CPC ..... E01C 11/24; E01C 5/22; A62C 33/06
USPC ..... 404/15, 19
See application file for complete search history.

(56) References Cited

U.S. PATENT DOCUMENTS

| | | | | |
|---|---|---|---|---|
| 42,218 A * | 4/1864 | Noe | E01C 5/16 | 404/21 |
| 696,322 A * | 3/1902 | Farmer | E04F 11/16 | 182/222 |
| 1,798,467 A * | 3/1931 | Hartzler | E01F 9/553 | 404/15 |
| 1,798,468 A * | 3/1931 | Hartzler | E01F 9/553 | 404/15 |

(Continued)

*Primary Examiner* — Matthew D. Troutman
(74) *Attorney, Agent, or Firm* — Foley Hoag LLP; Stephen J. Kenny

(57) ABSTRACT

A detectable warning tile system has a tile base with an upper surface and a lower surface. The upper surface has a plurality of upward projections therefrom. The tile base has two side edges for alignment with corresponding side edges of other tiles, and front and rear edges. An area of the upper surface of the tile base is formed free of the detectable warnings and may include a trough into or over which a replaceable tile section may be placed. The tile base and/or replaceable tile section may be configured to receive one or more individually-installable detectable warnings.

11 Claims, 7 Drawing Sheets

(56) References Cited

U.S. PATENT DOCUMENTS 1,816,502 A * 7/1931 Theel ..... E01F 9/553 404/15
1,918,336 A * 7/1933 Horni ..... E01F 9/553 404/15
1,966,227 A * 7/1934 Webster ..... E01F 9/553 404/15
2,321,476 A * 6/1943 Foster ..... E01F 9/553 156/246
3,091,996 A * 6/1963 Macrae ..... E01F 9/553 404/15
3,832,931 A * 9/1974 Talan ..... F16B 13/126 411/56
D293,880 S * 1/1988 Takahashi ..... 174/138 D
5,302,049 A * 4/1994 Schmanski ..... E01O 5/20 404/15
5,303,669 A * 4/1994 Szekely ..... E01C 5/22 116/205
5,800,109 A * 9/1998 Carruthers ..... F16B 19/004 411/455
5,890,842 A * 4/1999 Dahill ..... E02D 5/80 405/232
6,709,191 B1 * 3/2004 McCuskey ..... A61H 3/066 404/19
7,249,911 B2 * 7/2007 Hyams ..... E01C 19/44 404/15
7,674,066 B2 * 3/2010 Wehmeyer ..... A61H 3/066 404/19
7,758,279 B2 * 7/2010 Driscoll ..... E01O 5/00 404/19
7,779,581 B2 * 8/2010 Flaherty ..... E01C 5/20 116/205
7,955,024 B2 * 6/2011 Driscoll ..... E01C 5/16 404/19
7,992,360 B2 * 8/2011 Driscoll ..... E01C 5/00 404/15
7,993,074 B1 * 8/2011 Driscoll ..... E01C 5/00 404/19
2006/0039752 A1 * 2/2006 Hyams ..... E01C 19/44 404/19
2007/0092335 A1 * 4/2007 Wehmeyer ..... A61H 3/066 404/19
2007/0196169 A1 * 8/2007 Logan ..... E01C 23/18 404/9
2007/0201948 A1 * 8/2007 Harward ..... E01F 11/00 404/15
2010/0170192 A1 * 7/2010 Driscoll ..... E01C 5/001 52/747.1
2015/0265491 A1 * 9/2015 Henshue ..... E01O 5/001 404/19

* cited by examiner

PEDESTRIAN TILE, REPLACEABLE TILE SECTION AND/OR RESILIENT DOME STRUCTURE

This application is a Divisional application and claims the benefit under 35 U.S.C. § 121 of U.S. application Ser. No. 12/721,279 filed Mar. 10, 2010; which further claims the benefit of priority under 35 U.S.C. § 119 to U.S. Provisional Application No. 61/159,318 filed Mar. 11, 2009.

BACKGROUND OF THE INVENTION

The *Americans with Disabilities Act* (*ADA*): *Accessibility Guidelines for Buildings and Facilities* sets the requirements for the use of detectable warnings at curb ramps, walking surfaces, transit platforms and the like to warn visually impaired people of hazards. The Guidelines require that detectable warnings "shall consist of raised truncated domes with a diameter of nominal 0.9 in. (23 mm), a height of nominal 0.2 in. (5 mm) and a center-to-center spacing of nominal 2.35 in. (60 mm) and shall contrast visually with adjoining surfaces, either light on dark or dark on light. The material used to provide contrast shall be an integral part of the walking surface. Detectable warnings used on interior surfaces are required to differ from adjoining surfaces in resiliency or sound-on-cane contact." § 4.29.2. "Platform edges bordering a drop off and not protected by screens or guard rails shall have a detectable warning . . . 24 inches wide running the full length of the platform drop off" § 10.3.1(8). "If a walk crosses or adjoins a vehicular way, and the walking surfaces are not separated by curbs, railings or other elements between the pedestrian areas and the vehicular areas, the boundary between such areas shall be defined by a continuous detectable warning which is 36 in. (915 mm) wide". § 4.29.5. Curb ramps are also required to have detectable warnings extending the full width and depth of the curb ramp. See § 4.7.7.

Various tactile tiles having raised truncated domes in compliance with the ADA Guidelines or the equivalent have been developed. These tactile tiles are designed to be glued or mechanically fastened to the existing walking surface or embedded in freshly poured concrete or other settable medium. The truncated domes of these tiles are typically integrated with the tiles such that the domes are a permanent part of the tile.

In some circumstances, areas of the tactile tiles are subjected to frequent and repeated impact such that the truncated domes become chipped or otherwise damaged. In one example, the passenger floor of rail transit cars may be at a different elevation than a passenger platform onto which passengers disembark from the rail car. In other words, pedestrian passengers are required to step up or down to enter or leave the rail car. To accommodate wheelchair ingress/egress, a deployable platform ramp attached to the rail car provides access between the rail car and the different height of the passenger platform. When the ramp is deployed at a rail station onto ADA Guidelines-compliant detectable warnings (or their equivalents), the ramp may impact the truncated domes thereof at a particular distance from the rail car with sufficient force to immediately, or over time, damage the truncated domes in the tile area impacted by the ramp.

Tactile tiles are typically attached to a substrate in a manner, such as mentioned above, which makes removal prohibitively expensive or time intensive. Moreover, the manner of installation and/or dimensions of tactile tiles hinder the replacement of smaller tile portions that may be damaged or for which replacement may otherwise be desirable.

Furthermore, existing detectable warning tiles do not provide or accommodate sensors, lighting, message presentation, electrical or fluid paths, or access to connections for any of these which may exist in adjoining tiles.

SUMMARY OF THE DISCLOSURE

Consistent with some embodiments described in detail herein, a detectable warning tile has a generally planar tile base. The generally planar tile base includes an upper surface and a lower surface, the upper surface having formed thereon a plurality of detectable warnings upwardly projecting therefrom. The tile has two side edges for alignment with corresponding side edges of other tiles, and front and rear edges. The detectable warnings all have substantially the same base dimensions. The upper surface of the tile base includes an area free of detectable warnings and having a width and length each greater than two times the largest base dimension of the detectable warnings.

Alternatively, consistent with some embodiments, a detectable warning tile includes a generally planar tile base having an upper surface and a lower surface, said upper surface having thereon a plurality of detectable warnings upwardly projecting therefrom, said tile having two side edges for alignment with corresponding side edges of other tiles, and front and rear edges, wherein a portion of said tile base is formed as a trough, the trough formed integrally with the upper surface of the detectable warning tile and defining a depression in the upper surface and being capable of receiving a replaceable tile section.

Alternatively, consistent with some embodiments an individually-installable detectable warning includes a truncated dome having a narrow top portion and a wide base portion, and an attachment portion that projects orthogonally from the wide base portion of the truncated dome for attachment of the detectable warning to a detectable warning tile. The truncated dome and attachment portion are formed of a resilient material.

Alternatively, consistent with some embodiments a detectable warning tile system includes a tile having a molded tile base formed from a reinforced composite polymer, and including a plurality of integrated detectable warnings formed with the tile base. One or more individually-installable detectable warnings are installed in one or more areas of the tile base formed to receive the one or more individually-installable detectable warnings.

Alternatively, consistent with some embodiments a detectable warning tile system includes a tile base having upper and lower surfaces, the upper surface capable of receiving and supporting a replaceable tile section, and the replaceable tile section. The replaceable tile section includes one or more attachment elements for attaching the replaceable tile section to the tile base.

Alternatively, consistent with some embodiments a replaceable tile section includes a generally planar element having an upper surface and a lower surface, at least a portion of the lower surface formed to engage a receiving portion of a detectable warning tile.

The foregoing is a summary and thus contains, by necessity, simplifications, generalization, and omissions of detail; consequently, those skilled in the art will appreciate that the summary is illustrative only and is not intended to be in any way limiting. Other aspects, features, and advantages of the devices and/or processes and/or other subject matter described herein will become apparent in the teachings set forth herein. The summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

DETAILED DESCRIPTION

The following detailed description refers to the accompanying drawings. The samereference numbers in different drawings identify the same or similar elements. The following detailed description does not limit the invention. Instead, the scope of the invention is defined by the appended claims and equivalents thereof.

Features consistent with some embodiments provide for a detectable warning tile system. The system includes a detectable warning tile with a plurality of detectable warnings (e.g., truncated domes in accordance with the *Americans with Disabilities Act* (*ADA*): *Accessibility Guidelines for Buildings and Facilities*). The tile includes a tile base integrated with plurality of detectable warnings (e.g., truncated domes) and/or capable of receiving a plurality of individually-installable detectable warnings. Each of the individually-installable detectable warnings may include attachment portion or shaft projection capable of securely engaging with the tile base of the detectable warning tile when installed.

Alternatively, features consistent with some embodiments provide for a warning tile system including a detectable warning tile in which a tile base has a lowered trough or well capable of receiving a replaceable tile section. Such replaceable tile section may be configured in a variety of ways as discussed below. By providing a replaceable tile section in this manner, a damaged or worn replaceable tile section may be replaced relatively easily, access may be provided to structure below the replaceable tile section, and other functionality may be provided as discussed more fully below.

Figure 1:
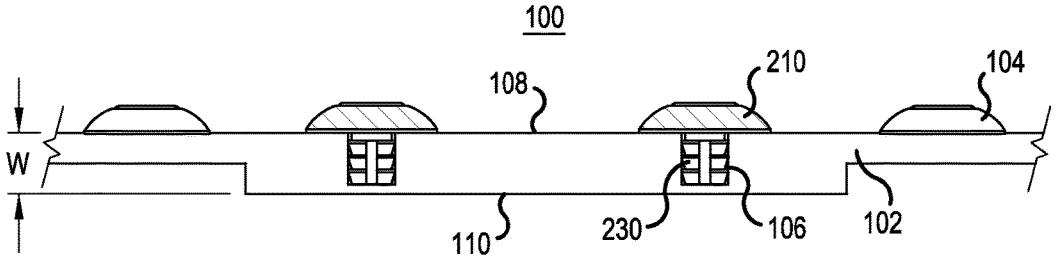
FIG. 1 is a cross section view of a detectable warning tile system incorporating individually installable detectable warnings consistent with the principles of some embodiments of the present disclosure.

In FIG. 1, a detectable warning tile system 100 includes a tile base 102 having a plurality of detectable warnings 104 integrated thereon. The detectable warnings 104 include, but are not limited to, truncated domes as specified by the *Americans with Disabilities Act* (*ADA*): *Accessibility Guidelines for Buildings and Facilities* or equivalents thereof. The plurality of detectable warnings 104 may be distributed over the entire top surface 108 of the tile base 102, in equally spaced rows, for example. The top surface 108 optionally may include raised dimples 309 (shown, for example, in FIGS. 4*a*, 4*d*, 4*e*) formed in a pattern on the top surface. Each integrally formed detectable warning has a base portion of the same dimensions. That is, one integrated detectable warning has the same base portion dimensions as other integrated detectable warnings on the tile. The detectable tile may include an area free of integrated detectable warnings, the area having a length and width each greater than two times the largest base portion dimension. The area free of integrated detectable warnings may be formed to receive individually-installable detectable warnings.

Figure 2A:
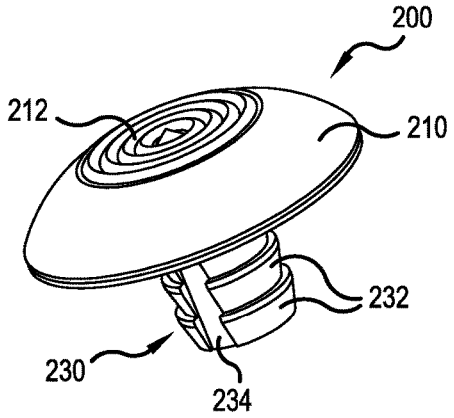
FIG. 2*a* is a perspective view of an individually installable detectable warning consistent with the principles of some embodiments of the present disclosure.
Figure 2B:
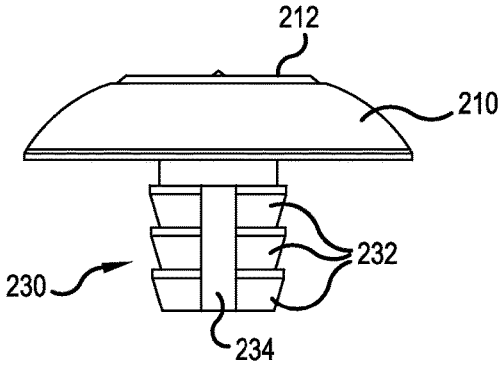
FIG. 2*b* is a plan view of an individually installable detectable warning consistent with the principles of some embodiments of the present disclosure.

As best shown in FIGS. 2*a* and 2*b*, an individually-installable detectable warning 200 may include a truncated dome portion 210 and an attachment portion 230. The attachment portion in the embodiment illustrated in FIGS. 2*a* and 2*b* is formed to include fluted barbs. The truncated dome portion 210 may be constructed of stainless steel or other durable material selected for its resilience against damage. A dome top 212 of the dome portion 210 may include one of various textures or patterns to increase friction of the dome portion 210 or for decoration or instruction. In FIG. 2*a*, for example, the pattern of the dome top 212 includes a series of concentric circular ridges. However, this dome-top pattern is merely one example and is not intended to limit the patterns which may be formed in a dome top.

The attachment portion 230 may comprise fluted barbs. In some embodiments, for example, the attachment portion 230 includes at least one annular rib or barb 232 surrounding the attachment portion. When viewed from the side (as in FIG. 2*b*) each barb 232 has a profile that approximates a truncated cone (i.e., tapers inward toward the attachment portion's longitudinal axis toward a lower portion of the individually-installable detectable warning). When the individually-installable detectable warning 200 includes a plurality of barbs 232, the profile approximates a stack of truncated cones. At least one vertical channel or flute 234 may be provided along the longitudinal length of the attachment portion shaft interrupting the barbs 232. Flutes may be formed on opposite sides of the attachment portion 230, 180 degrees apart. When the individually-installable detectable warning 200 is installed, each flute 234 engages surrounding material to hinder turning of the individually-installable detectable warning 200. The attachment portion 230 may further include one or more lateral protrusions (not shown) instead of, or in addition to, the flutes 234 to hinder turning of the individually-installable detectable warning 200.

An individually-installable detectable warning 200 may be installed into a preformed hole 106 of a base tile 102 with an interference fit. In this case, the hole 106 is smaller than the maximum diameter of the barbs 232 so that when the individually-installable detectable warning 200 is pressed or hammered into the hole 106, the barbs tightly engage the walls of the hole 106 to prevent removal. The material of the tile base 102, being softer than the individually-installable detectable warning 200, gives way to the individually-installable detectable warning 200 and enters the spaces of the flute(s) 234 and around the barb portion(s) 232. The individually-installable detectable warning 200 may additionally be installed using an adhesive material.

In an alternative embodiment, the attachment portion is formed having a non-circular cross-section, such as a square, triangle, oval, etc., to prevent the attachment portion from spinning in a correspondingly-shaped receiver hole 106. This may, for example, facilitate an orientation of an orientation-specific pattern, device, or lighting provided on the dome top 212. Flute(s) 234 provide less utility in such embodiments, but can be included nevertheless.

In still another embodiment, the attachment portion 230 is a threaded shaft which can be installed in the hole 106 and secured with, for example, a nut appropriately sized for the threaded shaft.

Yet another embodiment includes an attachment portion 230 that is expandable during installation. For example, the attachment portion may include a concrete-anchor type expandable portion that expands against the surrounding material (e.g., concrete) during installation to securely hold the attachment portion in place by interference.

Tile base 102 of a detectable warning tile may be provided with a predefined area 110 for receiving individually-installable detectable warning 200. In area 110, the thickness dimension"W" of base portion 102 may be greater than a length of the attachment portion of the individually-installable detectable warning 200. The thickness dimension at area 110 may be greater than the thickness of other areas of tile base 102.

Figure 6:
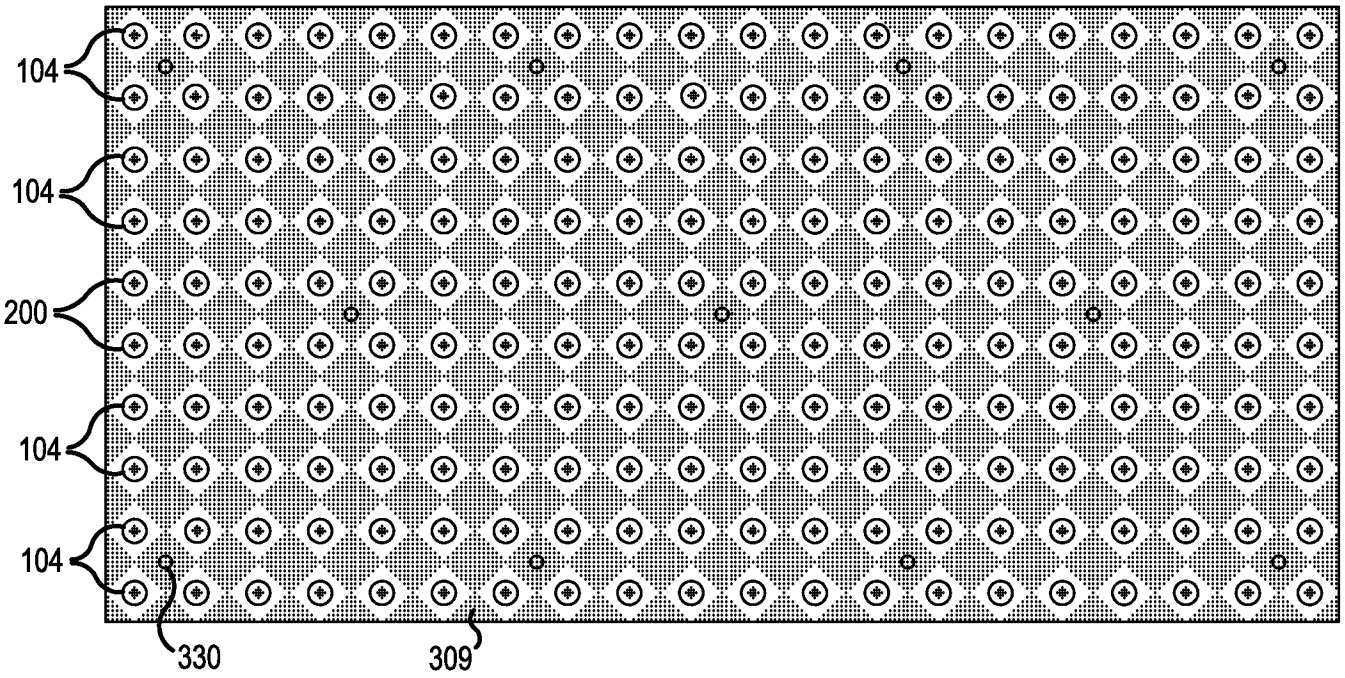
FIG. 6 is top view of a detectable warning tile consistent with the principles of some embodiments of the present disclosure.

FIG. 6 depicts a detectable warning tile incorporating a plurality of individually-installable detectable warnings 200 in a subset of equally spaced rows of detectable warnings. Alternatively, the arrangement of the detectable warnings 104, 200 may be random, in non-equally spaced rows, or other predetermined patterns.

FIGS. 3*a* to 3*d* and 4*a* to 4*e* illustrate a detectable warning system including a tile base 302 with integrated detectable warnings 304, a trough 310, and a replaceable tile section 320, 340, 350, 410. The detectable warnings 304 according to some embodiments form truncated domes in accordance with the above-noted ADA Guidelines (or their equivalents), and may further include a texture portion 306 on a top portion of the detectable warnings.

Figure 4A:
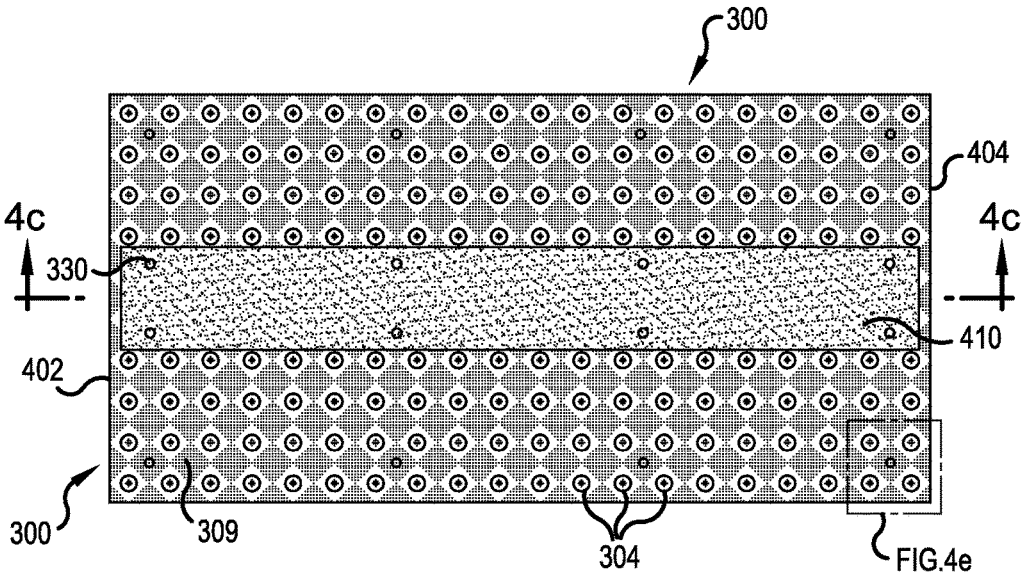
FIG. 4*a* is a top view of a detectable warning tile system incorporating a replaceable tile section consistent with the principles of some embodiments of the present disclosure.
Figure 4B:
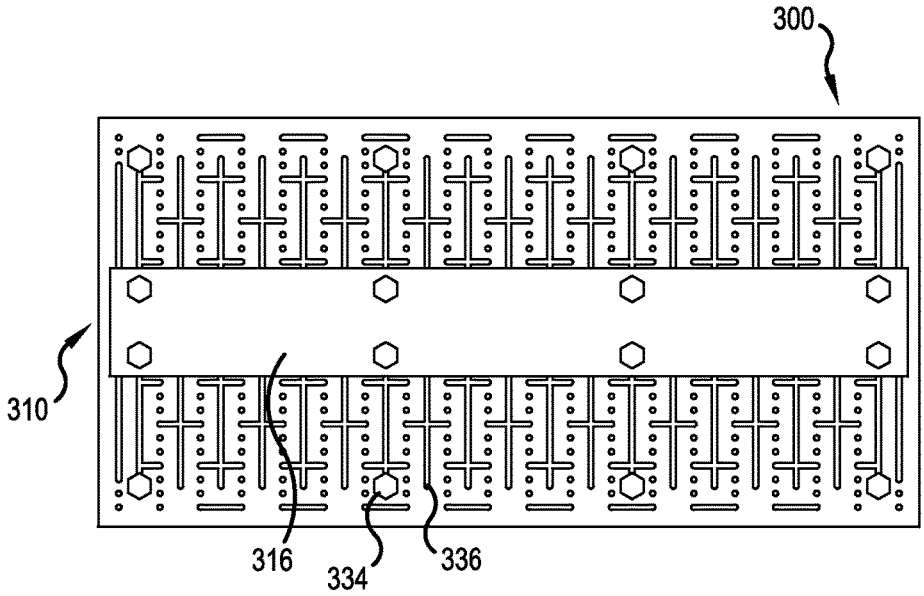
FIG. 4*b* is a bottom view of a detectable warning tile system consistent with the principles of some embodiments of the present disclosure.

The trough 310 may include walls 312 which are integrated with and depend from tile base 302, and a trough floor 314 which joins bottom portions of the walls 312 such that the trough walls and floor are a continuation of the upper surface of the tile base 302. Trough walls 312 may be vertical, stepped, or, for ease of manufacturing, angled slightly outward (i.e. sloped). The trough 310 thus defines a depression in the upper surface of the tile base. The trough 310, the bottom side of which is illustrated in FIG. 4*b*, for example, may be formed with parallel walls to form a rectangular section. However, the trough 310 is not limited to having parallel walls or rectangular shape. For example, the trough 310 may be formed in circular, oval, triangular, or other shapes when viewed from above the detectable tile. The trough 310 may be formed to receive a replaceable tile section, embodiments of which are discussed below, and may be formed to extend to at least one of opposite edges 402, 404. Alternatively, as illustrated in FIGS. 4*a* and 4*b*, the trough may not extend to either of the edges 402, 404. In this case, the trough 310 may include additional walls 312 on end portions of the trough, as shown in FIG. 4*d*.

Although the trough is illustrated in a central portion of a tile base, it may be appreciated that the trough may be formed in other positions, such as along one or more sides of a tile base. Moreover, in some embodiments, the entire surface of the tile base may be configured as a trough. In such embodiments, the "upper surface" of the tile base may receive one or more replaceable tile sections.

FIG. 4*b* depicts structure of a lower surface of a detectable warning tile 300 according to some embodiments. Detectable warning tile 300 includes the bottom side 316 of trough 310, bottom side of embedment anchors 338, and flanges 336 for securing the detectable warning tile in, for example, cement, concrete, or other material which sets or hardens upon curing.

Figure 3A:
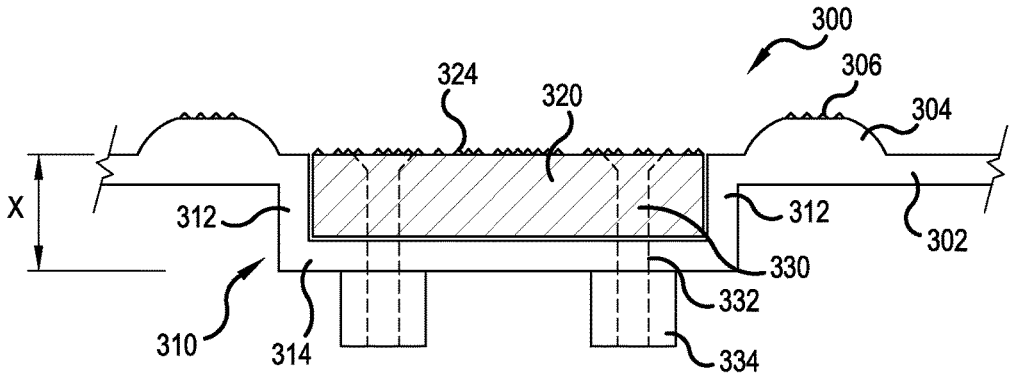
FIGS. 3*a*-3*d* are cross section views of detectable warning tile systems incorporating replaceable tile sections respectively comprising high-density polyethylene with embedded grit, high-density polyethylene, and stainless steel consistent with the principles of some embodiments of the present disclosure.
Figure 4C:
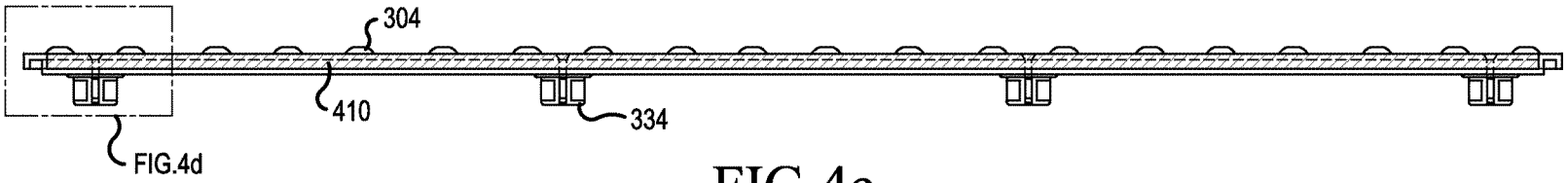
FIG. 4*c* is a cross section view of the detectable warning tile system consistent with the principles of some embodiments of the present disclosure.
Figure 4E:
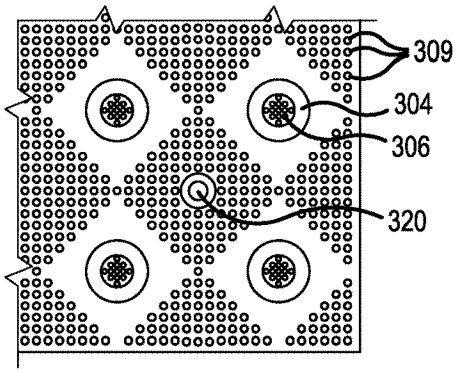
FIG. 4*e* is a detail view of a portion of the top of the detectable warning tile system consistent with the principles of some embodiments of the present disclosure.
Figure 4D:
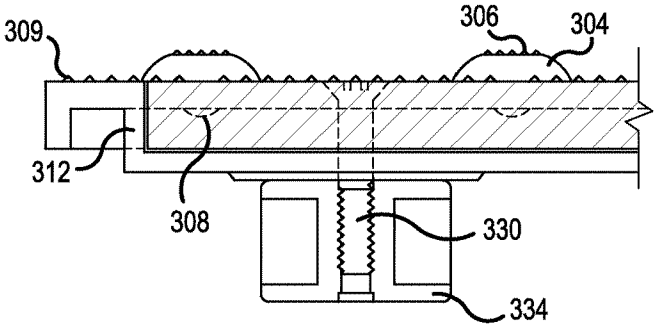
FIG. 4*d* is a detail cross section view of the detectable warning tile system consistent with the principles of some embodiments of the present disclosure.
Figure 5A:
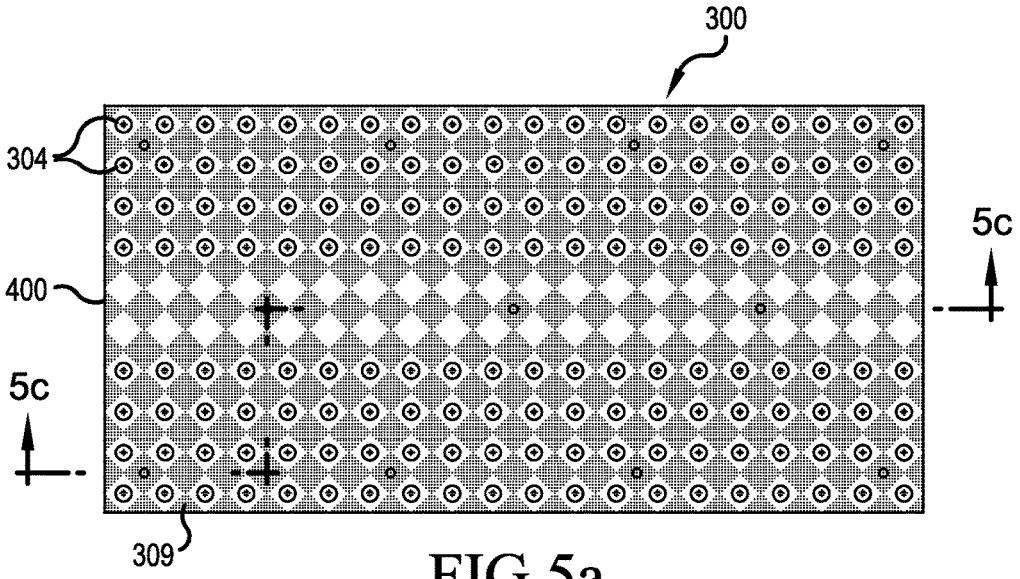
FIG. 5*a* is top view of a detectable warning tile consistent with the principles of some embodiments of the present disclosure.
Figure 5B:
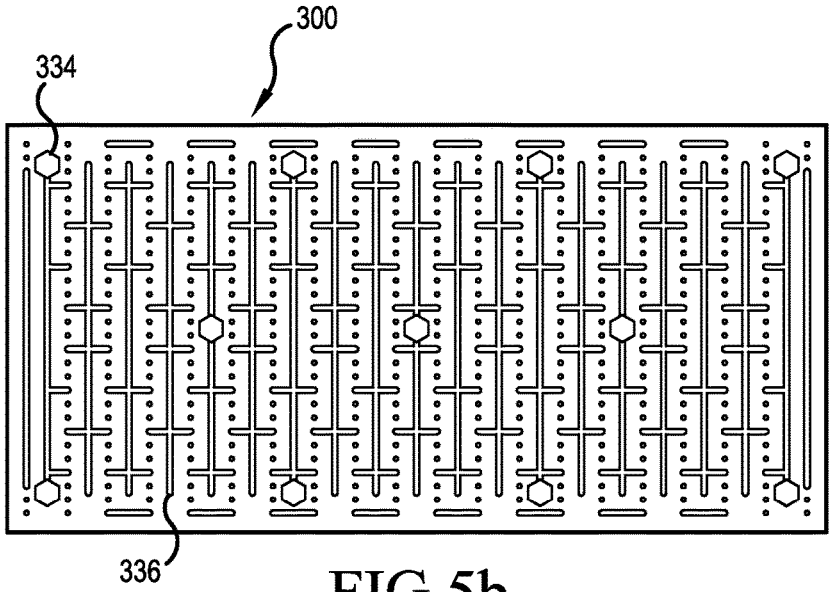
FIG. 5*b* is a bottom view of a detectable warning tile consistent with the principles of some embodiments of the present disclosure.
Figure 5C:
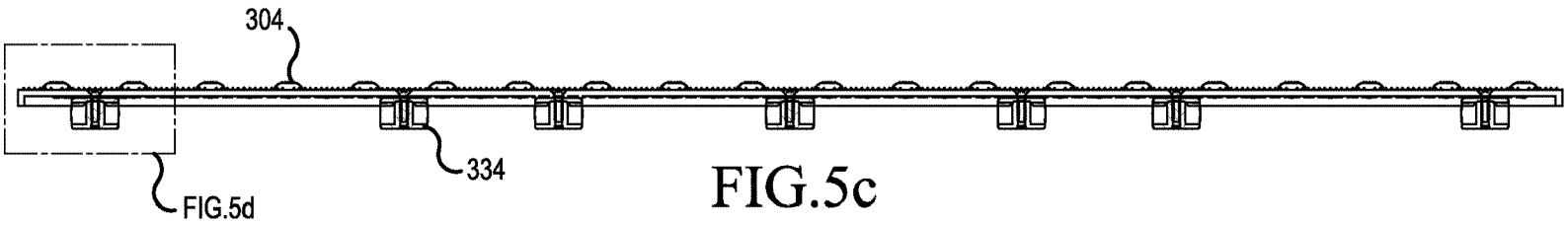
FIG. 5*c* is a cross section view of a detectable warning tile consistent with the principles of some embodiments of the present disclosure.
Figure 5D:
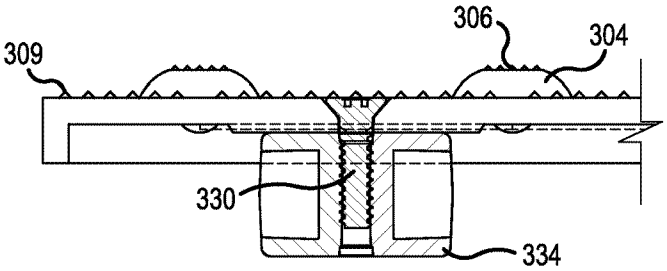
FIG. 5*d* is a detail cross section view of a detectable warning tile consistent with the principles of some embodiments of the present disclosure.

FIG. 4*c* depicts a cross section A-A of detectable warning tile 300 including a replaceable tile section 410 shown in FIG. 4*a*. FIG. 3*a* depicts a partial cross section B-B of detectable warning tile 300 including replaceable tile section shown in FIG. 4*a*.

Figure 3B:
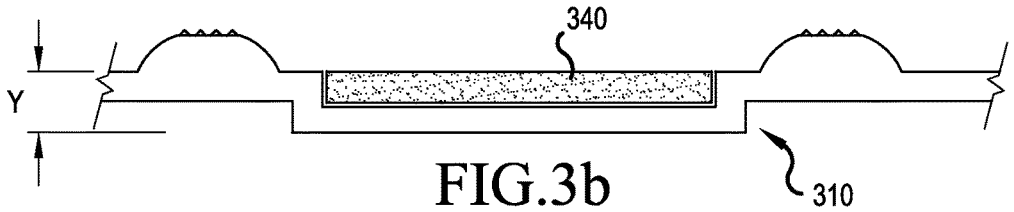
Figure 3C:
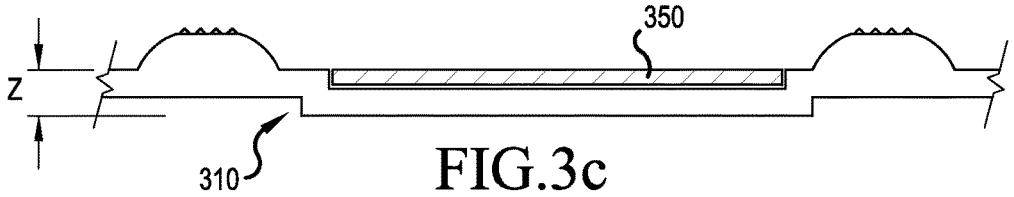

Depending on the intended application, replaceable tile section 320, 340, 350, 410 may comprise generally planar elements formed from materials of differing qualities. For example, a replaceable tile section 320 may be formed of high density polyethylene (HDPE) having grit 324 embedded therein to increase the friction characteristics of the replaceable tile section 320. The grit may include, by way of non-limiting example, silicon carbide, aluminum oxide, and/or other highly durable material. Alternatively, the replaceable tile section may include plain HDPE, steel plate such as diamond plate, or other durable material. Further still, the replaceable tile section may be formed of rubber or an elastic material. Thickness of various materials forming the replaceable tile section and the depth of the corresponding trough 310 may be selected for rigidity, to achieve cost or weight savings, or for ease of installation, storage, and transit, etc., as illustrated in FIGS. 3*a*-3*c*. For example, in order to accept a thick replaceable tile section 320, a depth "X" of trough 310 in FIG. 3*a*, may be formed deeper than the trough 310 in FIG. 3*c*, which is formed to accommodate a material of smaller thickness "Z".

Consistent with some embodiments, the replaceable tile section 320, 340, 350, 410 may include a cross-hatching pattern formed, i.e., molded, etched, etc., on an upper surface of the replaceable tile section in order to provide a non-slip surface. The cross-hatched pattern may further provide for drainage of water from the replaceable tile section and tile. It may be appreciated that alternative patterns may be formed on the upper surface of the replaceable tile section.

The replaceable tile section may be securely affixed to a tile base 302 via at least one attachment element, such as a bolt-receiving hole for receiving a bolt 330 as illustrated in FIGS. 4*a* and 4*d*. Bolt 330 may be provided through the replaceable tile section, into an attachment element receiving portion such as hole 332 in the tile base 302, and in some embodiments secured within embedment anchor 334. It may be appreciated that alternative attachment elements or affixing methods may be used to secure the replaceable tile section to the tile. For example, replaceable tile section 410 may include a protrusion (not shown) depending from a lower surface of the replaceable tile section for engagement with a protrusion-receiving element, may be secured with adhesive, or may be unsecured—being held in place only by its own weight and/or the walls 312 of the trough 310. It may also be appreciated that the replaceable tile section may be secured using one or more of the individually replaceable detectable warnings described herein, in which case the attachment portion 230 of the detectable warning may engage with a portion of the trough through a hole in the replaceable tile section (not shown). By providing the replaceable tile section in this manner, the replaceable tile section may be removed and/or replaced with another replaceable tile section without requiring the detectable warning tile to be removed/replaced. In some applications, a seal or gasket may be placed at an edge portion of the replaceable tile section 410 or at a lip and the trough 310 to, for example, prevent access to an underside of the replaceable tile section by liquids or gases.

FIG. 4*a* is a top view of a detectable warning tile 300 showing the replaceable tile section 320, 340, 350, 410 installed in a center portion. However, it should be noted that the detectable warning tile 300 may be formed to accommodate a replaceable tile section 410 in other orientations or positions. For example, the trough 310 may be formed nearer to one edge than to the opposite edge of the detectable warning tile 300.

A replaceable tile section may be formed with integrated detectable warnings. For example, a replaceable tile section 410 formed of stainless steel may include integrated or welded stainless steel detectable warnings. In an alternative embodiment of the replaceable tile section, a steel plate section includes threaded studs. In this case, the attachment portions of the detectable warnings are corresponding threaded receiver holes configured to receive the threaded studs. The replaceable tile section may itself include threaded receiver holes for receiving a detectable warning having a corresponding threaded stud.

Figure 3D:
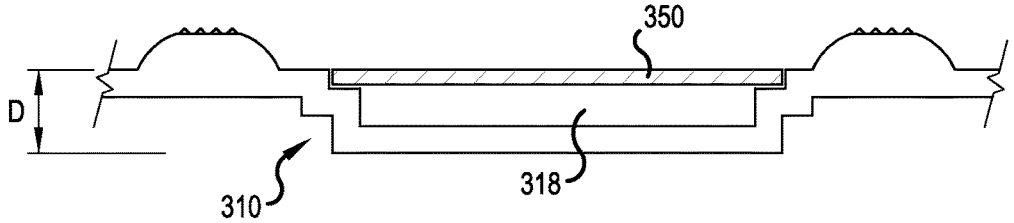

FIG. 3*d* illustrates the trough 310 having a depth "D" greater than the thickness of the replaceable tile section, thus providing space 318 beneath an installed replaceable tile section for accommodation of, for example, runs of electrical wires or plumbing, and/or access to heating elements or electrical components formed or installed at the vertical walls 312 of the trough. In such case, the replaceable tile section covers the trough 310 without being supported by the entire trough floor 314. As shown in FIG. 3*d*, a step may be formed above each vertical wall 312 of the trough 310, and the replaceable tile section rests on the step. The trough floor 314 may include one or more channels of preselected width and depth to accommodate, for example, heating elements, wiring, plumbing, lighting elements, circuitry, etc. The size and number of channels may depend on the strength of the material forming the replaceable tile section 410 such that the replaceable tile section may bridge the channel(s) without significantly weakening the structural integrity of the replaceable tile section under normal use.

The replaceable tile section may also, or alternatively, include one or more cutouts to accommodate access to features of a detectable warning tile. Non-limiting examples of such features include a drain, an audio speaker, lighting, etc. The replaceable tile section may also include, or provide access to, features intended for wayfinding. For example, the replaceable tile section and/or detectable warning tile may include electrical or mechanical devices that provide or activate wayfinding signals (e.g., audio signals to inform, direct, or alert a pedestrian).

The replaceable tile section may include one or more electrical components, such as a lighting fixture to, for example, provide warning or guidance to train passengers. In one embodiment, the lighting fixtures include patterns of light emitting diodes (LEDs) which are controlled via associated driver and programming circuitry that may be communicably linked to a computer network for transmitting and receiving data, the circuitry being programmable to control the LEDS to flash or display messages.

The replaceable tile section may include motion or pressure transducers embedded therein to detect traffic thereon. Detection of motion or pressure may initiate generation of audio or visual indications to passengers. Transducers may be included in the tile base or in the detectable warnings. The audio or visual indications may themselves be embedded in or secured to the replaceable tile section 410 or in an area provided beneath the replaceable tile section.

In another embodiment of the replaceable tile section, the material forming the replaceable tile section includes Eco-Glo (TRADEMARK) or other photoluminescent anti-slip material to provide emergency egress lighting.

Another embodiment includes a replaceable tile section which covers the entire surface of the tile.

The replaceable tile section of any embodiment may be formed of material having a color which matches or contrasts with a color of the surrounding tile or may be transparent or translucent. The replaceable tile section further may be formed using multiple colors such that the section includes branding, a message, or visual warning.

The terms "a" and "an" herein do not denote a limitation of quantity, but rather denote the presence of at least one of the referenced item. Unless defined otherwise, technical and scientific terms used herein have the same meaning as is commonly understood by one of skill in the art to which this disclosure belongs.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the disclosure without departing from the essential scope thereof. Therefore, it is intended that the invention not be limited to the particular embodiments disclosed as the best mode contemplated for carrying out this invention, but that the invention will include all embodiments falling within the scope of the appended claims.

What is claimed is:

1. A detectable warning system, comprising:

a tile base having a plurality of individually-installable detectable warnings, the tile base having a first region with a first thickness, and a second region with a second thickness, the second thickness being greater than the first thickness;

at least one detectable warning disposed within the second region of the tile base, the detectable warning including a truncated dome having a narrow top portion and a wide base portion the truncated dome protruding above the tile, and an attachment portion that projects orthogonally from the wide base portion of said truncated dome for attachment of the individually-installable detectable warning to a detectable warning tile, the attachment portion having a first end and a second end defining a length therebetween, the attachment portion having one or more barbs extending away from a longitudinal axis of the attachment portion, and at least one flute formed along the length of the attachment portion and interrupting the one or more barbs, wherein the truncated dome and attachment portion are formed of a first material; and wherein the tile is formed of a softer material than the truncated dome and attachment portion.

2. The detectable warning system according to claim 1, wherein the truncated dome includes a friction pattern on its top portion.

3. The detectable warning system according to claim 1, wherein the attachment portion is cylindrical and comprises one or more barbs, each tapering inward away from the truncated dome.

4. The detectable warning system according to claim 1, wherein the attachment portion is a shaft formed to provide an interference fit against sides of a hole in the tile.

5. The detectable warning system according to claim 1, wherein at least the truncated dome is formed of stainless steel.

6. The detectable warning system according to claim 1, wherein the truncated dome has a diameter of nominal 0.9 inch (23 mm), and a height of nominal 0.2 inch (5 mm).

7. The detectable warning system according to claim 1, wherein the attachment portion is formed with a non-circular cross section.

8. The detectable warning system according to claim 1, wherein an adhesive bonds the individually-installable detectable warning to the tile.

9. The detectable warning system according to claim 1, wherein the second thickness of the tile is greater than a length of the attachment portion of the individually-installable detectable warning.

10. A method of replacing an individually-installable detectable warning, comprising:

accessing a tile having a plurality of detectable warnings, the detectable warnings having a truncated dome having a narrow top portion and a wide base portion; the tile having a first region with a first thickness, and a second region with a second thickness, the second thickness being greater than the first thickness;

identifying a hole in the tile section;

installing an individually-installable detectable warning including a truncated dome within a hole in the second region of the tile with the truncated dome protruding above the tile;

wherein the individually-installable detectable warning includes an attachment portion, the attachment portion having a first end and a second end defining a length therebetween with a plurality of barbs projecting laterally outward to engage the tile, the attachment portion having at least one flute formed along the length of the attachment portion and interrupting at least one of the barbs.

11. The method of replacing an individually-installable detectable warning according to claim 10, wherein the attachment portion is formed with a non-circular cross section.

* * * * *